United States Patent [19]

Daleo

[11] 4,249,401

[45] Feb. 10, 1981

[54] MULTIPLE HANDCUFF ARRANGEMENT

[75] Inventor: Joseph Daleo, Deer Park, N.Y.

[73] Assignee: Triple Cuff Corporation, Melville, N.Y.

[21] Appl. No.: 1,721

[22] Filed: Jan. 8, 1979

[51] Int. Cl.[3] ..... E05B 75/00

[52] U.S. Cl. ..... 70/16

[58] Field of Search ..... 70/16, 14, 15, 17, 18, 70/49

[56] References Cited

U.S. PATENT DOCUMENTS

| | | | |
|---|---|---|---|
| 1,410,802 | 3/1922 | Foster | 70/16 |
| 1,823,697 | 9/1931 | Nenstiehl | 70/16 |
| 1,881,948 | 10/1932 | Rayburn | 70/16 |
| 4,162,622 | 7/1979 | Daleo | 70/16 |

*Primary Examiner*—Robert L. Wolfe

*Attorney, Agent, or Firm*—Posnack, Roberts, Cohen & Spiecens

[57] ABSTRACT

Three handcuffs are connected in series by a pair of chains. These chains are connected to the handcuffs by eyes which are connected to the respective heads of the handcuffs and by an additional eye which is connected to the pivot of the centrally located handcuff. With the handcuffs extended, two of the handcuffs are adapted to assume coplanar relationship and the other handcuff is located in an offset parallel plane.

3 Claims, 3 Drawing Figures

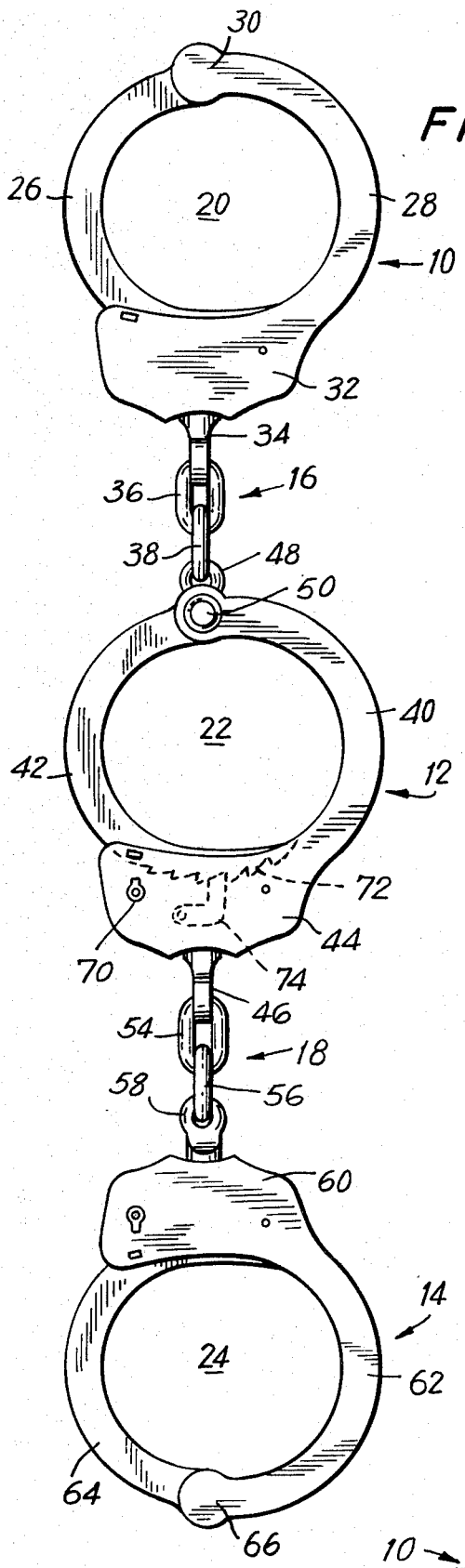
FIG. 1
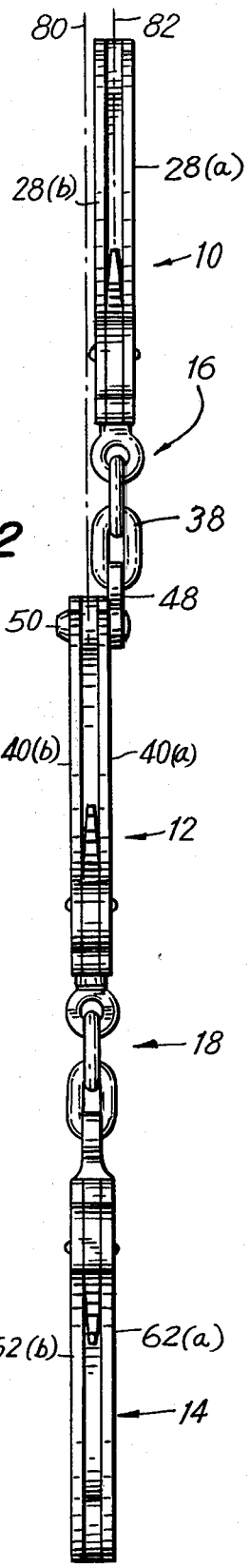
FIG. 2
FIG. 3
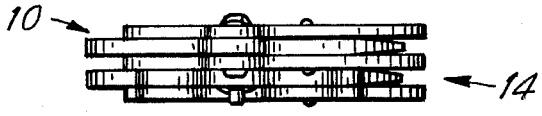

MULTIPLE HANDCUFF ARRANGEMENT

FIELD OF INVENTION

This invention relates to handcuffs and, more particularly, to multiple cuff arrangements.

BACKGROUND

Handcuffs are generally arranged in pairs connected by chains and are used for purposes of limiting the mobility of prisoners and the like. Such handcuffs are generally somewhat restricted in use by reason of the fact that only one prisoner and at most two prisoners can generally be handcuffed by the known arrangements whereas, sometimes it is necessary to handcuff a greater number of prisoners. In addition, the known arrangements of handcuffs have limited utility and it would be advantageous to provide a construction which would have a greater amount of utility.

One multiple linkage arrangement is known in which a waistband has connected thereto two handcuffs. This is a very specialized structure intended generally to embrace the waist of a prisoner and the two hands thereof and, accordingly, this known construction is for a different purpose than is the construction of the instant invention as will be shown hereinafter.

SUMMARY OF INVENTION

It is an object of the invention to provide an improved handcuff arrangement.

It is another object of the invention to provide an improved handcuff arrangement comprising a series arrangement of multiple cuffs.

Another object of the invention is to provide an improved handcuff arrangement which permits the coupling of two or more prisoners to a stationary object.

Yet another object of the invention is to enable the handcuffing of two prisoners to a guard or the like.

In achieving the above and other objects of the invention, there is provided an apparatus comprising a plurality of handcuffs of at least substantially equal size and flexible means connecting the handcuffs in series.

In the aforesaid arrangement, said flexible means are chains of equal size. The handcuffs include first and second cuff parts and pivot means coupling said cuff parts together, said cuff parts respectively forming respective halves of a circle, said second part being adapted for straddling said first part.

In accordance with another aspect of the invention, the chains each include at least two interengaged links and there are provided eyes on said handcuffs engaging the aforesaid links. Moreover, each of said handcuffs include a head part generally diametrally opposed to the associated pivot means and connected to the associated second cuff part.

In a specific arrangement according to the invention there are provided three handcuffs, one of said chains connecting a first of the handcuffs to a second of the handcuffs, another of the chains connecting the second of the handcuffs to a third of the handcuffs.

According to still another aspect of the invention a first, second and third of the aforesaid eyes are respectfully mounted on the heads of the first, second and third handcuffs and a fourth of said eyes is mounted on the pivot means of said second handcuff, said chains connecting said first and fourth and said second and third eyes together.

According to still another aspect of the invention, said second and third handcuffs are adapted, with said handcuffs fully extended, to be in coplanar relation with said first handcuff being offset in a parallel plane.

Other objects, features and advantages of the invention will be found in the detailed description which follows hereinafter as illustrated in the accompanying drawing.

BRIEF DESCRIPTION OF DRAWING

In the drawing:

FIG. 1 is a top view of a triple handcuff arrangement provided in accordance with a preferred embodiment of the invention;

FIG. 2 is a side view of the handcuff arrangement of FIG. 1; and

FIG. 3 is an end view of the handcuff arrangement of FIG. 1.

DETAILED DESCRIPTION

As illustrated in the drawing, there is provided in accordance with the invention a multiple handcuff arrangement consisting of handcuffs 10, 12 and 14. The first and second handcuffs 10 and 12 are connected together by a chain 16. The second and third handcuffs 12 and 14 are connected together by a chain 18.

The handcuffs are preferably fabricated of a strong material such as steel, although other materials may be substituted therefor. Stainless steel is used in a preferred construction of the invention or nickel plated steel or chrome plated steel may also be preferably employed.

The three handcuffs 10,12 and 14 are preferably of at least substantially identical construction. When closed, the handcuffs define a generally circular opening such as respectively indicated at 20,22 and 24, these openings being generally accommodations for the wrists of one, two or three prisoners and/or guard personnel or the like. It will also be noted that one or more of the handcuffs may be used to engage a pipe or other fixed structure or the like. In addition, it will be noted that where a pipe or the like is located close to a wall or some other fixed structure, it will be possible to slip one of the handcuffs and associated chains between the pipe and such wall whereupon the placing of the handcuffs on two prisoners or the like will limit the mobility of these persons.

The handcuff 10 consists of cuff parts 26 and 28 which are connected together by a pivot (not shown) concealed by portion 30. The parts 26 and 28 generally form halves of a circle conforming to opening 20. A head part 32 is mounted on the part 28, the part 28 consisting of parts 28 (*a*) and 28 (*b*) which cooperatively are capable of straddling the part 26 when the latter is displaced relative thereto on the pivot concealed by part 30. The head part 32 has an eye 34 mounted thereon and engaging link 36 of chain 16, there being a second link 38.

Handcuff 12 similarly consists of two parts 40 and 42 whereof part 44 consists of spaced parts 40, 40(*a*) and 40 (*b*) straddling under certain circumstances the part 42. A head part 44 is mounted on part 40 and has connected thereto an eye 46, a further eye 48 being mounted in generally diametrally opposed relationship thereto on a pivot 50 which connects parts 40 and 42 together.

Link 54 of chain 18 is connected to link 56. Link 54 engages eye 46 and link 56 engages eye 58 which is mounted on the head part 60 of handcuff 14 which includes parts 62 and 64 pivoted together at 66. The part 62 consists of part 62 (*a*) and 62 (*b*) spaced and parallel in order to accommodate therebetween under special circumstances the part 64.

The head part of each of the cuffs has formed therein a keyhole such as indicated, by way of example, at 70 on the head part 44 of the centrally located handcuff 12. The purpose of the keyhole 70 is to admit the insertion of a key whereby the associated handcuff may be locked and unlocked. Indicated in phantom lines and diagramatically is the serrated edge 72 of the accommodated part 42 of handcuff 12 therebeing a locking cam 74 operatively associated with the key mechanism to prevent withdrawal of the serrated part 72 or ratchet whereby the handcuff 12, by way of example, is locked.

As best seen in FIG. 2, handcuffs 12 and 14 with the handcuff arrangement extended are adapted to assume coplanar relationship as exemplified by the plane indicated at 80. The handcuff 10 by reason of displacement of the chain 16 is adapted to assume a displaced or offset relationship in a spaced and parallel plane indicated at 82. The pivot 50 is a double headed pivot arrangement adapted to lock, to the handcuff 12, the eye 48 for purposes of engaging the link 38 of the chain 16.

From what has been described above, it will now be apparent that the invention provides an apparatus comprising a plurality such as three of handcuffs of at least substantially equal size and construction with flexible means such as chains connecting the handcuffs in series. The handcuffs each include first and second cuff parts with pivot means coupling the same with the cuff parts respectively forming respective halves of a circle. The second part is generally formed of two parts adapted for straddling or otherwise engaging the other part. The chains each preferably include two interengaged links with eyes being provided on the handcuffs engaging the aforesaid links.

Each of the handcuffs includes a head part generally diametrally opposed to the associated pivot means and connected to the associated cuff part which is formed of two parallel spaced parts.

In accordance with the invention, one of the chains connects the first of handcuffs to the second of the handcuffs and another of the chains connects the second of the handcuffs to a third of the handcuffs. A first, second and third of the aforesaid eyes are respectively mounted on the heads of the first, second and third handcuffs and a fourth of said eyes is mounted on the pivot means of said second handcuff, said chains connecting said first and fourth and said second and third eyes together.

As noted hereinabove, said second and third handcuffs are adapted with said second handcuffs fully extended to be in coplanar relation with the remaining handcuff being offset in a parallel plane.

There will now be obvious to those skilled in the art, many modifications and variations of the construction set forth hereinabove. These modifications and variations will not depart from the scope of the invention if defined by the following claims.

What is claimed is:

1. Apparatus comprising three handcuffs of at least substantially equal size, and flexible means connecting the handcuffs in series, said flexible means being chains, said handcuffs each including first and second cuff parts and pivot means coupling said cuff parts together, said cuff parts respectively forming respective halves of a circle, said second part being adapted for engaging said first part, the chains each including at least two interengaged links, eyes on said handcuffs engaging said links, each of said handcuffs including a head part generally diametrally opposed to the associated pivot means and connected to the associated second cuff part, one of said chains connecting a first of the handcuffs to a second of the handcuffs, another of the chains connecting the second of the handcuffs to a third of the handcuffs, a first, second and third of said eyes being respectively mounted on the heads of the first, second and third handcuffs, and a fourth of said eyes being mounted on the pivot means of said second handcuff, said chains connecting said first and fourth and said second and third eyes together.

2. Apparatus as claimed in claim 1 wherein said second and third handcuffs are adapted, with said handcuffs fully extended, to be in coplanar relation with said first handcuff being offset in a parallel plane.

3. Apparatus as claimed in claim 2 wherein said chains are of equal length.

* * * * *